US008353464B2

(12) United States Patent
Ho

(10) Patent No.: US 8,353,464 B2
(45) Date of Patent: Jan. 15, 2013

(54) TUNABLE VIBRATION ABSORBING DEVICE

(76) Inventor: Wai Lun Ho, Hong Kong (HK)

( * ) Notice: Subject to any disclaimer, the term of this patent is extended or adjusted under 35 U.S.C. 154(b) by 204 days.

(21) Appl. No.: 12/741,202

(22) PCT Filed: Sep. 16, 2008

(86) PCT No.: PCT/CN2008/072369

§ 371 (c)(1),
(2), (4) Date: May 3, 2010

(87) PCT Pub. No.: WO2009/059512

PCT Pub. Date: May 14, 2009

(65) Prior Publication Data

US 2010/0258647 A1 Oct. 14, 2010

Related U.S. Application Data

(60) Provisional application No. 60/985,986, filed on Nov. 7, 2007.

(51) Int. Cl.
*E01B 19/00* (2006.01)
*F16F 7/10* (2006.01)

(52) U.S. Cl. ..... 238/382; 188/379

(58) Field of Classification Search ..... 238/382, 238/151–153; 188/378–380; 310/93
See application file for complete search history.

(56) References Cited

U.S. PATENT DOCUMENTS

| | | | | |
|---|---|---|---|---|
| 3,525,472 | A * | 8/1970 | Sato | 238/151 |
| 6,390,382 | B1 * | 5/2002 | Hodgson et al. | 238/382 |
| 6,402,044 | B1 * | 6/2002 | Sato | 238/382 |
| 7,234,647 | B2 * | 6/2007 | Wirthwein et al. | 238/382 |

FOREIGN PATENT DOCUMENTS

| | | | |
|---|---|---|---|
| EP | 1186710 | * | 3/2002 |
| GB | 2399123 | A | 9/2004 |
| GB | 2403759 | A | 12/2005 |
| WO | 2004097115 | A1 | 11/2004 |

* cited by examiner

*Primary Examiner* — Robert McCarry, Jr.

(57) ABSTRACT

A Tuned Mass Damper (TMD) for reducing vibration and noise radiation from rails incorporates a series of oscillation mass (8) of different sizes held in position by layers of resilient material (9) and attached to the rail via several steel mounting plates (4). Each mounting plate (4) is fixed to the rail by two magnets (5). A bolt (10) is inserted through the mounting plates (4), resilient layers (9) and oscillation masses (8) alternatively. The bolt (10) is fixed to a middle mounting plate (4) such that different compressive forces can be provided on the two sides by tightening nuts (11) to different pre-set torques. When the resonance frequency of the oscillation masses (8) is tuned to that of rail, most of the rail vibration energy at resonance frequency is transferred to the oscillation masses (8) and eventually dissipated in the resilient layers (9).

19 Claims, 4 Drawing Sheets

TUNABLE VIBRATION ABSORBING DEVICE

CROSS-REFERENCE TO RELATED APPLICATION

This application claims benefit under 35 U.S.C. §119(e) of U.S. Provisional Application having Ser. No. 60/985,986 filed Nov. 7, 2007, which is hereby incorporated by reference herein in its entirety.

RELATED APPLICATIONS

This patent application is a National Stage of International Application Serial No. PCT/CN2008/072369, filed Sep. 16, 2008, which claims the benefit of U.S. provisional application Ser. No. 60/985,986, filed on Nov. 7, 2007, the disclosures of which are all incorporated herein by reference in their entireties.

FIELD OF INVENTION

This invention relates to a device for vibration absorption, and in particular a vibration absorbing device for reducing vibration and noise radiation from rails.

BACKGROUND OF INVENTION

Environmental railway noise has drawn increasing concerns as railway lines extended into residential areas. Wayside noise barriers are commonly used to reduce the noise impacts on nearby residents. In the last two decades, more efforts were developed to control rail noise radiation at source by attachment of vibration dampers, mostly Tuned Mass Damper (TMD), directly onto the rails. However, installation of dampers on operating urban rails is normally restricted to 2 to 4 non-service hours in midnight, thus such methods are not universally accepted.

SUMMARY OF INVENTION

In the light of the foregoing background, it is an object of the present invention to provide an alternate method and device for tunable vibration absorption.

Accordingly, the present invention, in one aspect, is a device for reducing noise and vibration of rail, which includes at least one oscillation mass and at least one mounting member. The oscillation mass and the mounting member are separated by a resilient layer.

In an exemplary embodiment of the present invention, the mounting member is fixed to the rail by two magnets. The device further includes a bolt and two nuts, where the bolt is inserted through the oscillation masses, the resilient layers and the mounting members. The bolt is screwed to the middle mounting member and inserted through oversized holes of other mounting members. The nuts are installed on two ends of said bolt, whereby different compressive forces are provided to the resilient layers on the two sides of the middle mounting member by adjusting the torque of said nuts.

The present invention provides a method of mounting the damper to the rail with magnets to solve the above problems. The attachment method minimizes movement gaps at the mounting interface, therefore allows efficient vibration energy transfer from the rail to the damper. In contrast to clamping, the magnetic restoring force allows the mounting rigidity to be maintained in operating rails which are subjected to severe vibrations induced by train passage. The quick-fit attachment method allows faster damper installation.

Details of the attachment method and other features will be revealed in the following descriptions and drawings.

Traditional method of fixing rail vibration dampers by clamping or gluing is not satisfactory due to introduction of unavoidable small size movement gaps at attachment interface during the retrofit process in non-operating hours of the railroad. The small gaps hinder energy transfer from the rails to the dampers and significantly reduce overall energy absorption. The device of the present invention solves the above problems. Moreover, the attachment method is extremely simple, such that the device can be efficiently installed during non-operating hours of the railroad.

DETAILED DESCRIPTION OF THE PREFERRED EMBODIMENTS

Figure 1:
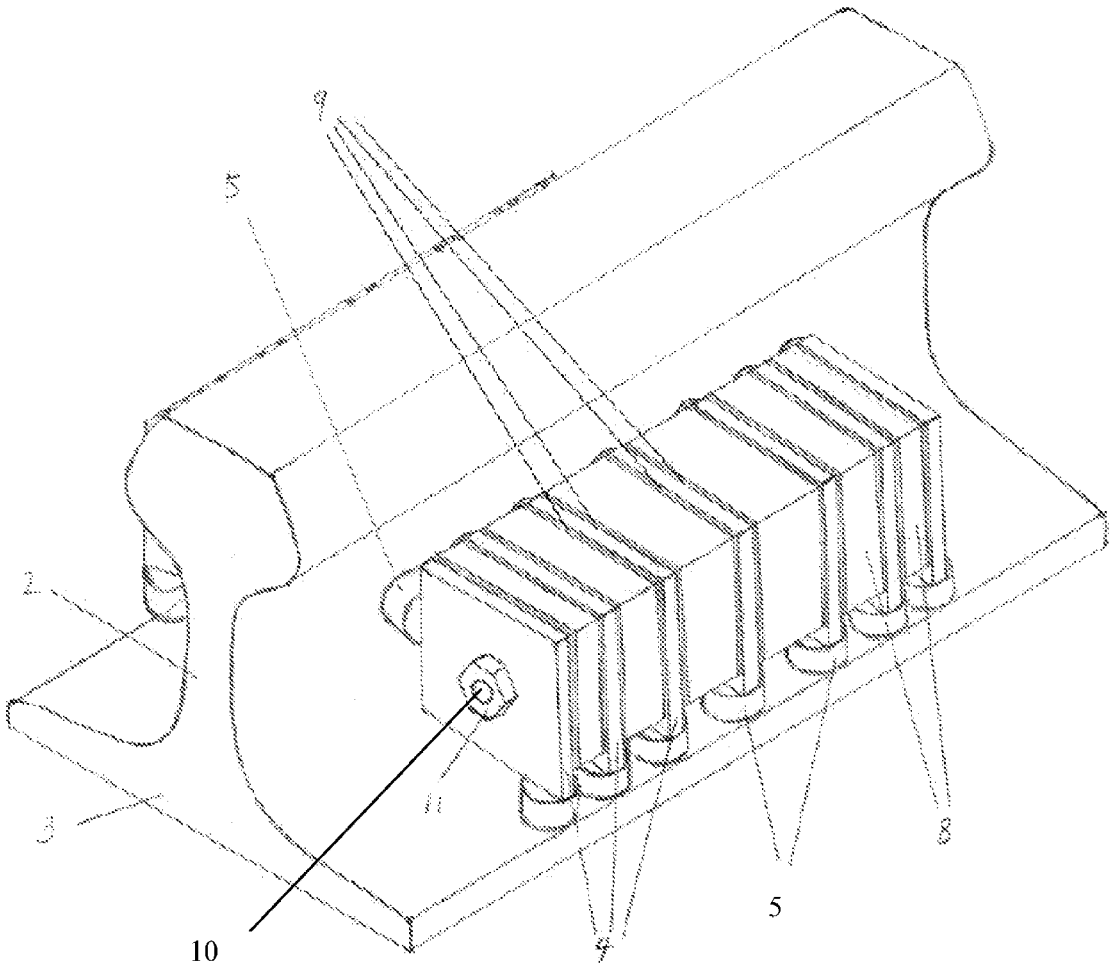
FIG. 1 shows an isometric drawing of the damper being attached to the rail.

Referring now to FIG. 1, in a first embodiment of the present invention, the damper includes a series of oscillation masses 8 of different sizes attached to the rail via several steel mounting members, or mounting plates 4. The oscillation masses are made of steel or other high-density materials. They are held in position by layers of resilient material 9 such as natural rubber or synthetic rubbers like silicone rubbers, neoprene, polyurethane, etc. Each mounting plate 4 is fixed to the rail by a magnetic object which includes two magnets 5. A bolt 10 is inserted through the mounting plates 4, resilient layers 9 and oscillation masses 8 alternatively. The bolt 10 is fixed to one of the middle mounting plates 4 such that different compressive forces can be provided on the two sides by tightening the nuts 11 installed on two ends of the said bolt to different pre-set torques. The bolt and nuts compose a fastener.

Figure 2:
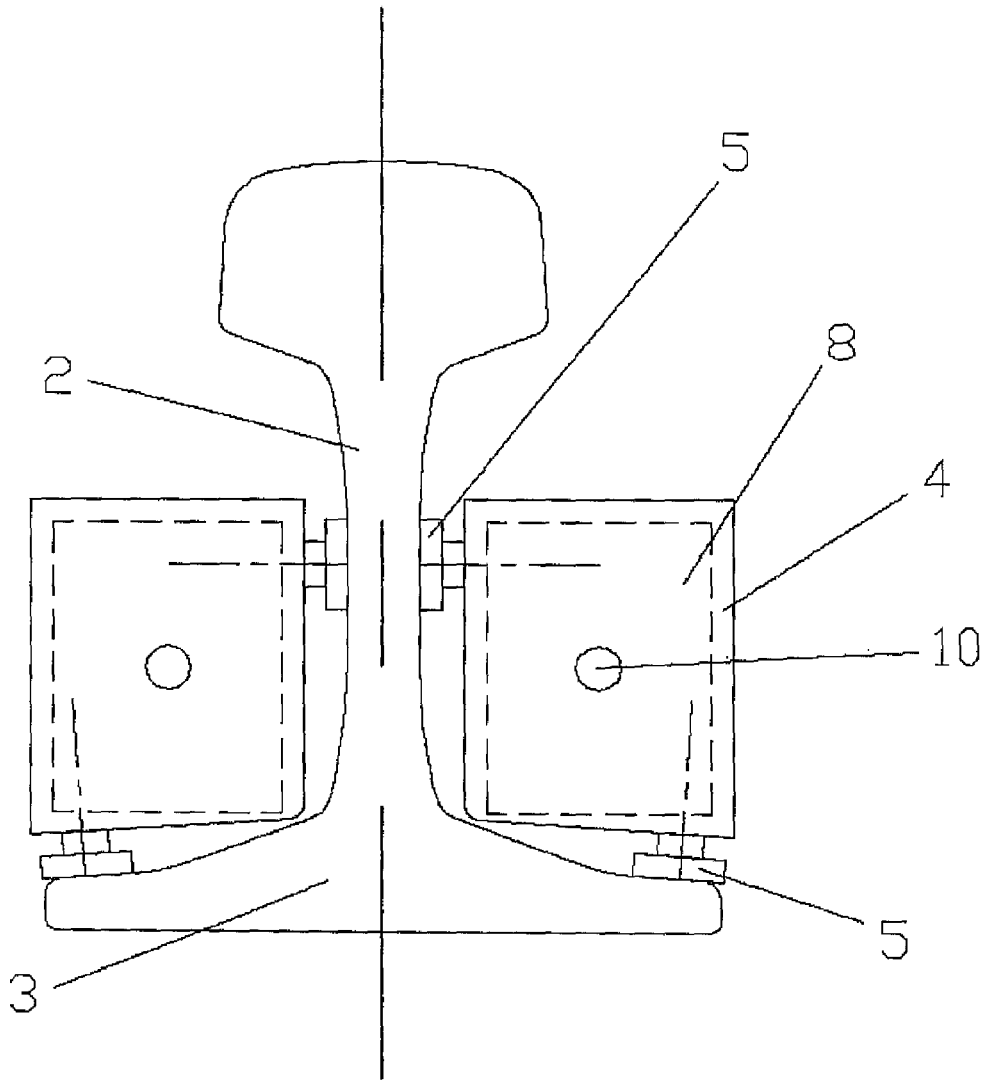
FIG. 2 shows a cross sectional view of the rail with damper being attached to foot and the web of the rail according to a first preferred embodiment of the invention.
Figure 3:
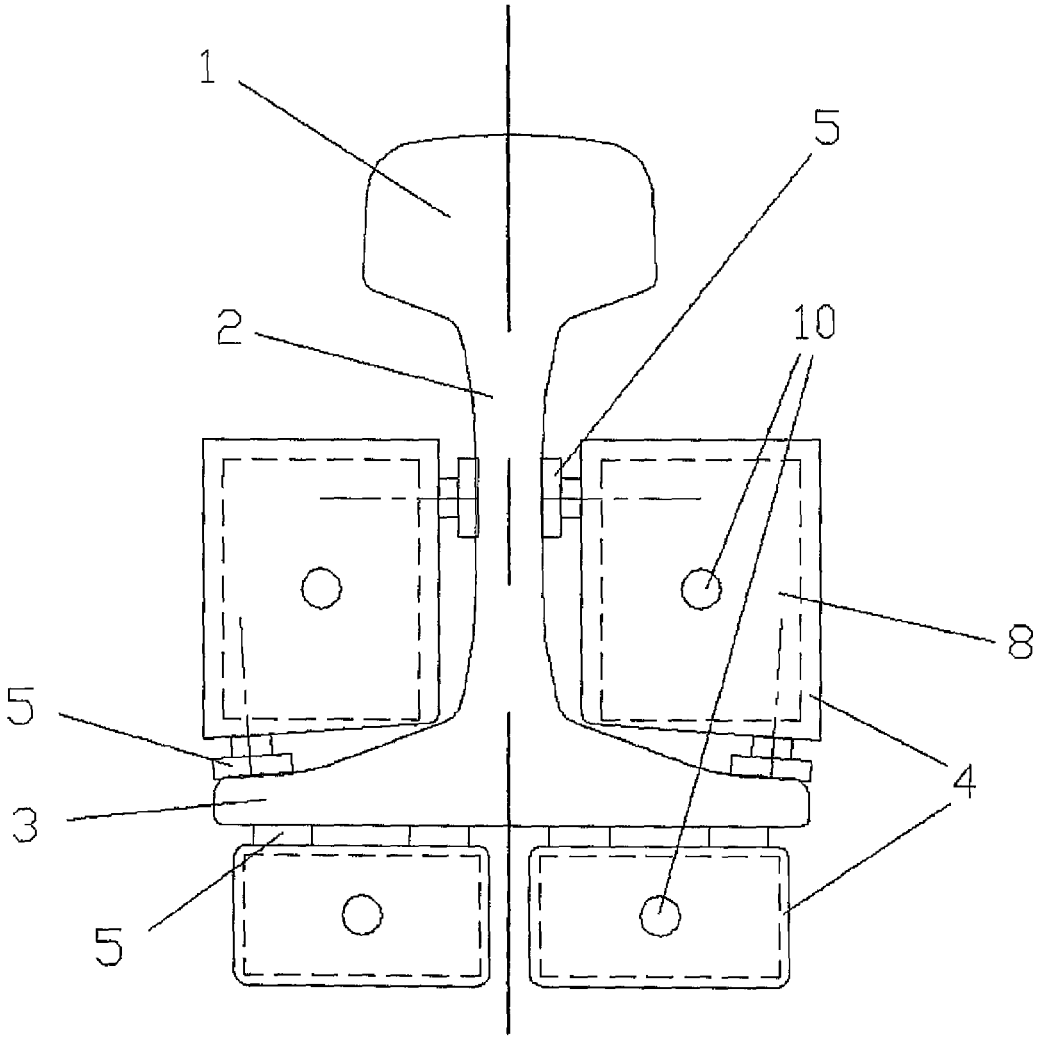
FIG. 3 shows a cross sectional view of the rail with additional dampers being attached underneath the rail foot according to a second preferred embodiment of the invention.

FIG. 2 shows an exemplary embodiment of the invention, where the damper is attached to the rail foot 3 and rail web 2 such that both vertical and lateral vibration can be effectively transferred and absorbed. FIG. 3 shows another exemplary embodiment of the invention, where additional dampers are attached underneath the rail foot 3 to enhance vibration absorption in the vertical direction.

Figure 4:
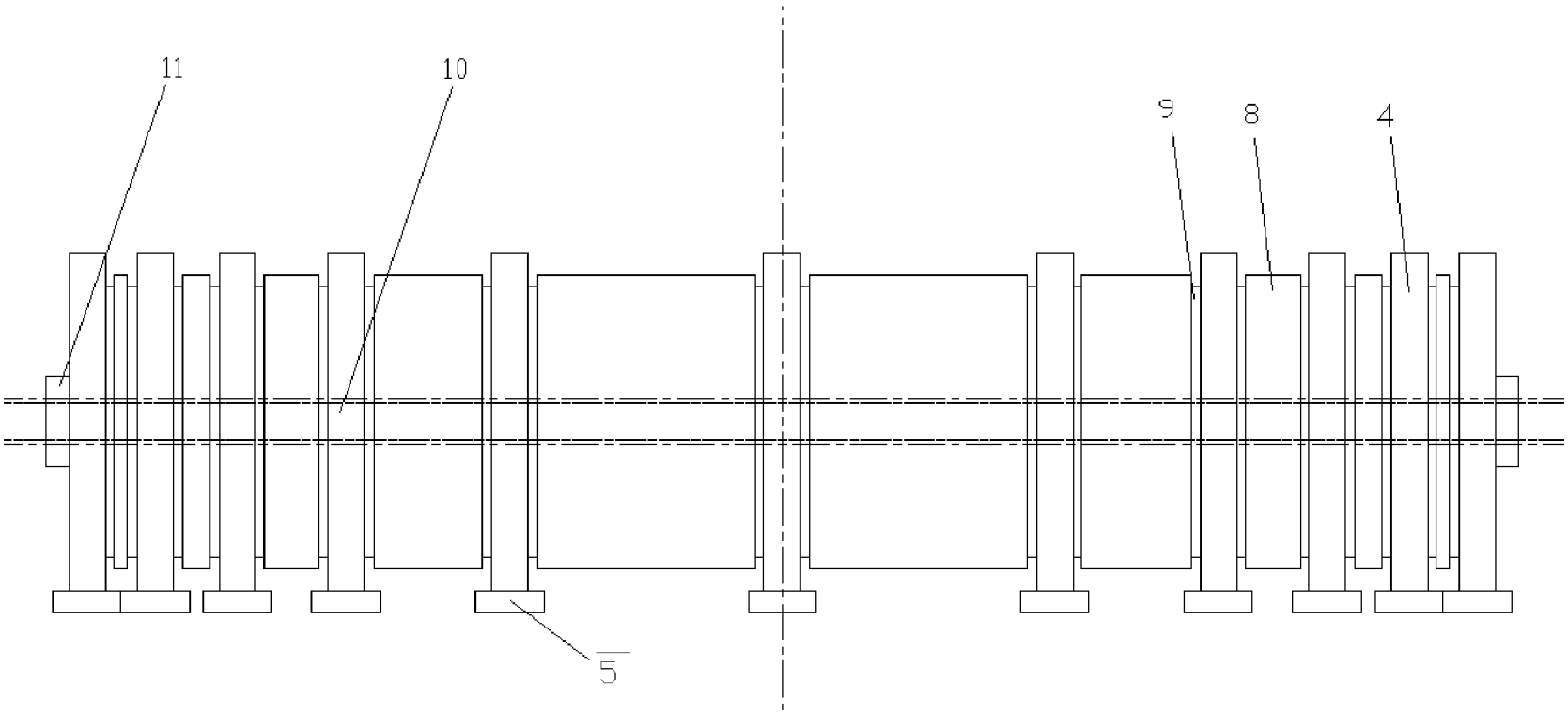
FIG. 4 shows the side view of a typical arrangement of the rail damper.

In another exemplary embodiment as shown in FIG. 4, the oscillation masses 8 have different thickness, and each oscillation mass 8 is separated by two resilient layers placed on two sides of the oscillation mass.

Working Principles

The oscillation masses of the damper vibrate along the shear direction of resilient layers. When resonance frequencies of the oscillation masses as shown in Eqt. 1 are tuned to the rail resonant frequencies, most of the rail vibration energy at resonant frequencies is transferred via the mounting plates into the oscillation masses and then dissipated at resilient layers by hysteresis. The effectiveness of vibration absorption depends on the resonance bandwidth, which depends on the mechanical loss factor of the resilient material. A narrower bandwidth gives higher vibration absorption. Appropriate resilient material having relatively small mechanical loss factor is chosen such that each oscillation mass covers a narrow absorption bandwidth for effective absorption at that frequency. The damper contains multiple oscillation masses to widen the absorption bandwidth. Typically, the damper can be designed to cover a continuous absorption bandwidth of approximately 2 to 4 octave bands.

Each oscillation mass is held at equilibrium position by resilient layers on two sides. The resilient layers are placed perpendicular to the rail such that both vertical and lateral rail vibrations result in shearing of the resilient layers. Resilient materials have more effective energy dissipation in shearing directions than in compression direction. This is superior to existing commercial products where resilient layers not perpendicular to the rail and energy dissipation of vertical and lateral rail vibration cannot be both dissipated in shearing directions of the resilient layers. The resonance frequencies of the oscillation masses can be described by the equation $$f_n = \frac{1}{2\pi}\sqrt{\frac{2GA}{bM}} \qquad \text{eqt (1)}$$

where G is dynamic shear modulus of the resilient layers
A is the contact area between the resilient layer and the oscillation mass
b is the thickness of the resilient layer
M is the oscillation mass Installation Before fixing the damper to the rail, the rail surfaces are brushed to remove loosen rust and debris. After placing the damper on the rail, slight tapping on the damper is conducted to ensure that the relative positions of the mounting plates are adjusted to fit the local rail surface profile. Movement gaps at the mounting interface are minimized with or without filler materials at the mounting interface. The damper nuts are then tightened to the pre-set torque to fix the relative position of mounting plates as the last step of the installation. The compression from the bolt and nut system provides a static frictional force at the contact surfaces between the oscillation masses and the resilient layers. Therefore, the oscillation masses are held in equilibrium position by the frictional force.

Magnetic Mounting

Mounting rigidity is critical for effectiveness of vibration dampers. Rail vibration magnitudes at noise radiation frequencies above 300 Hz are normally on the order of microns. Vibration below 300 Hz is of less concern due to low noise radiation efficiency from the rail. If the mounting points have small movement gaps of sub-micron size or larger, energy transferred to the damper will be significantly hindered.

In contrast to traditional rail damper mounting methods such as clamping and gluing, the invention uses magnetic mounting. Each mounting plate is fixed to the rail by two magnets. The two-point attachment method allows the mounting plates to be best fit and rigidly fixed to the rail for transmission of lateral and vertical vibration. Filler material, such as wax or other material with similar creep resistance, can be applied at the attachment point to enhance coupling between the rail and the magnet. Each magnet is designed to provide an attractive force to the rail in the range of 5 to 200N, such that sufficient mounting force is provided to the damper. The damper mounting force is designed to be around 1 to 20 gravitational accelerations.

During installation, the damper is slightly tapped to ensure the mounting points to be adjusted to the best-fit locations according to local rail surface profile. Any movement gaps at the mounting interface are minimized. Occasionally, passage of flat-wheeled trains or mal-maintenance trains may cause severe rail vibration higher than the damper mounting force. The damper may be instantaneously dislocated. However any instantaneous dislocations in vertical and lateral directions would be restored to a fit location by the magnetic force after train passage. This suppresses growth of any movement gaps at the mounting points.

On-site Tuning

The invention allows on-site frequency tuning of the damper to optimize the rail vibration energy absorption at certain frequencies, as resonant frequencies of the rail may shift over time. The resilient layers can be designed with wavy or other special patterns on one or both surfaces such that their shear modulus increases with compression force. The compression force is provided by bolt and nut system by controlling the pre-set torque on the nuts. The bolt is fixed to one of the middle mounting plates such that different compressive forces can be provided on the two sides of the middle mounting plates by tightening the nuts to different pre-set torques. Therefore resonance frequencies of the oscillation masses can be fine-tuned on site, in addition to frequency tuning at the factory.

The exemplary embodiments of the present invention are thus fully described. Although the description referred to particular embodiments, it will be clear to one skilled in the art that the present invention may be practiced with variation of these specific details. Hence this invention should not be construed as limited to the embodiments set forth herein.

In the exemplary embodiments described above, the dampers are installed on both side of the rail. However, one skilled in art should realize that other ways of installing the dampers can also be adopted. For example, the damper can be attached to single side of the rail, or a single damper is attached underneath the rail instead of two.

What is claimed is:

1. A device for reducing noise and vibrations of a rail having a rail foot and a rail web, said device comprising:

at least one oscillation mass;

at least one mounting member for fixing said at least one oscillation mass to said rail; and at least one resilient layer that is disposed adjacent to said at least one oscillation mass and that is operative to separate said at least one oscillation mass from said at least one mounting member;

wherein said at least one resilient layer is disposed perpendicular to said rail and is operative to vibrate along the shear direction of said at least one resilient layer;

whereby the vertical and lateral vibration of the rail causes shear deformation of said at least one resilient layer when the resonant frequency of said at least one oscillation mass is tuned to match the resonant frequency of said rail and the kinetic energy of said rail is transmitted through said at least one mounting member to said at least one oscillation mass and is dissipated in said resilient layer by elastic hysteresis.

2. The device according to claim 1, wherein said at least one mounting member is fixed to said rail by a magnetic object.

3. The device according to claim 2, wherein said magnetic object comprises at least two magnets, one of said at least two magnets being attachable to the rail foot and another of said at least two magnets being attachable to the rail web.

4. The device according to claim 1, further comprising:

a fastener that is inserted through said at least one oscillation mass, said at least one resilient layer, and said at least one mounting member;

wherein different compressive forces are exertable on said at least one resilient layer and said at least one mounting member by adjusting said fastener.

5. The device according to claim 4, wherein said fastener further comprises:

a bolt and two nuts, each of said two nuts being installed on a different end of said bolt;

wherein different compressive forces is are exertable on said at least one resilient layer and said at least one mounting member by adjusting the torque of said two nuts.

6. The device according to claim 4, wherein said at least one resilient layer has an uneven pattern on at least one surface, whereby the shear modulus of said at least one resilient layer increases with compressive force exerted by said fastener.

7. The device according to claim 6, wherein each of said plurality of oscillation masses has a different thickness and the resonance frequency of each of said plurality of oscillation masses is correlated with its thickness.

8. The device according to claim 5, further comprising:

a plurality of oscillation masses;

a plurality of mounting members; and a plurality of resilient layers;

wherein said bolt is fixed in one of said mounting members and different compressive forces are exertable on said resilient layers disposed on different sides of said one of said mounting members by adjusting said nuts;

whereby the shear modulus of said resilient layers disposed on different sides of said one of said mounting layers are tunable separately.

9. A device for reducing noise and vibrations of a rail comprising:

at least one oscillation mass and at least one mounting member;

a resilient layer that is disposed between said at least one oscillation mass and said at least one mounting member; and means for tuning the resonant frequency of said at least one oscillation mass to the resonant frequency of the rail by compressing said resilient layer;

wherein said resilient layer has an uneven pattern on at least one surface.

10. The device according to claim 9, wherein said resilient layer is placed perpendicular to said rail such that said at least one oscillation mass vibrates along the shear direction of said resilient layer.

11. The device according to claim 9, wherein said at least one mounting member is fixed to said rail by a magnetic object.

12. The device according to claim 1, wherein said magnetic object comprises at least two magnets.

13. The device according to claim 12, wherein each of said at least two magnets has an attractive force to said rail in the range of 5 to 200N.

14. The device according to claim 9, wherein said means for tuning the resonant frequency of said at least one oscillation member to the resonant frequency of the rail comprises a fastener that is inserted through said at least one oscillation mass, said resilient layer and said at least one mounting member, whereby different compressive forces are exerted on said resilient layer and said at least one mounting member by adjusting said fastener.

15. The device according to claim 14, wherein said fastener further comprises a bolt and two nuts; said bolt being inserted through said at least one oscillation mass, said resilient layer, and said at least one mounting member; each of said nuts being installed on an end of said bolt; whereby different compressive forces are exerted on said resilient layer and said at least one mounting member by adjusting the torque of said nuts.

16. The device according to claim 14, wherein said resilient layer has an uneven pattern on at least one surface, whereby the shear modulus of said resilient layer increases with compressive force exerted by said fastener.

17. The device according to claim 14, wherein said device further comprises a plurality of mounting members; said bolt is attached to one of said plurality of mounting members.

18. The device according to claim 14, wherein said device further comprises a plurality of oscillation masses and a plurality of resilient layers, each said oscillation masses being disposed adjacent to one of said plurality of resilient layers.

19. The device according to claim 18, wherein some of said plurality of oscillation masses have different thicknesses, the resonance frequency of each of said plurality of oscillation mass being correlated with its thickness.

* * * * *